US008087887B2

(12) United States Patent
Lee et al.

(10) Patent No.: US 8,087,887 B2
(45) Date of Patent: Jan. 3, 2012

(54) FAN AND FAN FRAME THEREOF

(75) Inventors: Chia-Chen Lee, Taoyuan Hsien (TW); Shun-Chen Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 707 days.

(21) Appl. No.: 12/210,154

(22) Filed: Sep. 12, 2008

(65) Prior Publication Data

US 2009/0246017 A1 Oct. 1, 2009

(30) Foreign Application Priority Data

Mar. 28, 2008 (TW) ..... 97111251 A

(51) Int. Cl.
*F01D 1/10* (2006.01)
*F01D 25/24* (2006.01)

(52) U.S. Cl. ..... 415/220; 415/219.1

(58) Field of Classification Search ..... 415/220, 415/219.1
See application file for complete search history.

(56) References Cited

U.S. PATENT DOCUMENTS

| | | | | |
|---|---|---|---|---|
| 7,311,492 | B2 * | 12/2007 | Ostberg | 415/126 |
| 2006/0280632 | A1 * | 12/2006 | Sugiyama et al. | 417/423.5 |
| 2007/0258812 | A1 * | 11/2007 | Lee et al. | 415/220 |
| 2007/0286726 | A1 * | 12/2007 | Yabuuchi | 415/220 |
| 2008/0085188 | A1 * | 4/2008 | Hanlon | 415/220 |
| 2008/0273973 | A1 * | 11/2008 | Yamamoto et al. | 415/220 |

* cited by examiner

*Primary Examiner* — Nitin Parekh
(74) *Attorney, Agent, or Firm* — Muncy, Geissler, Olds & Lowe, PLLC

(57) ABSTRACT

A fan includes an impeller, a motor and a fan frame. The motor is coupled to the impeller and drives the impeller to rotate. The impeller and the motor are accommodated in the fan frame. The fan frame has a main body, an inner circular portion formed with a passage, a guiding portion forming an outlet of the fan, a motor base and a plurality of supporting elements. The guiding portion is connected to the inner circular portion. The motor base is disposed in the center of the passage on the main body. The supporting elements are connected between the main body and the motor base, and each of the supporting elements has a suspended portion which is not connected to the guiding portion.

19 Claims, 4 Drawing Sheets

FAN AND FAN FRAME THEREOF

CROSS REFERENCE TO RELATED APPLICATIONS

This Non-provisional application claims priority under 35 U.S.C. §119(a) on patent application No(s). 097111251, filed in Taiwan, Republic of China on Mar. 28, 2008, the entire contents of which are hereby incorporated by reference.

BACKGROUND OF THE INVENTION

1. Field of Invention

The present invention relates to a fan and fan frame thereof, and in particular to a fan and fan frame thereof capable of reducing noise and increasing air pressure.

2. Related Art

Since electronic devices have been developed towards high performance, high frequency, high speed and more compact, they also generate higher temperature. Because higher temperature will cause the unstable of the electronic devices and thus affect the reliability thereof, thus it is an important issue in the development of electronic devices to solve the heat dissipation issue.

A fan is a commonly used heat dissipation device. For different systems, fans with different characteristic curves are utilized to fit the requirements. In this case, as for two fans with similar air pressure and volume effects, the lower noise is the key factor for choosing the suitable fan.

SUMMARY OF THE INVENTION

In view of the foregoing, the present invention is to provide a fan and fan frame thereof capable of efficiently decreasing the noise and maintaining/enhancing the original airflow characteristics so as to dissipate heats from the electronic devices.

To achieve the above, the present invention discloses a fan including an impeller, a motor and a fan frame. The motor is coupled to the impeller and drives the impeller to rotate. The impeller and the motor are accommodated in the fan frame. The fan frame includes a main body, a motor base and a plurality of supporting elements. The main body includes an inner circular portion formed with a passage and a guiding portion connected to the inner circular portion and forming an outlet. The motor base is disposed in the main body and located at a center of the passage. The supporting elements are connected between the inner circular portion of the main body and the motor base. Each supporting element has a suspended portion, which is not connected to the guiding portion.

As mentioned above, the fan and fan frame of the present invention have the supporting elements, which are not connected to the guiding portion of the outlet. Thus, the redundant structure at the guiding portion, which may cause the resistance of the airflow, can be avoided, thereby preventing from affecting the air pressure characteristics and increasing noise.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
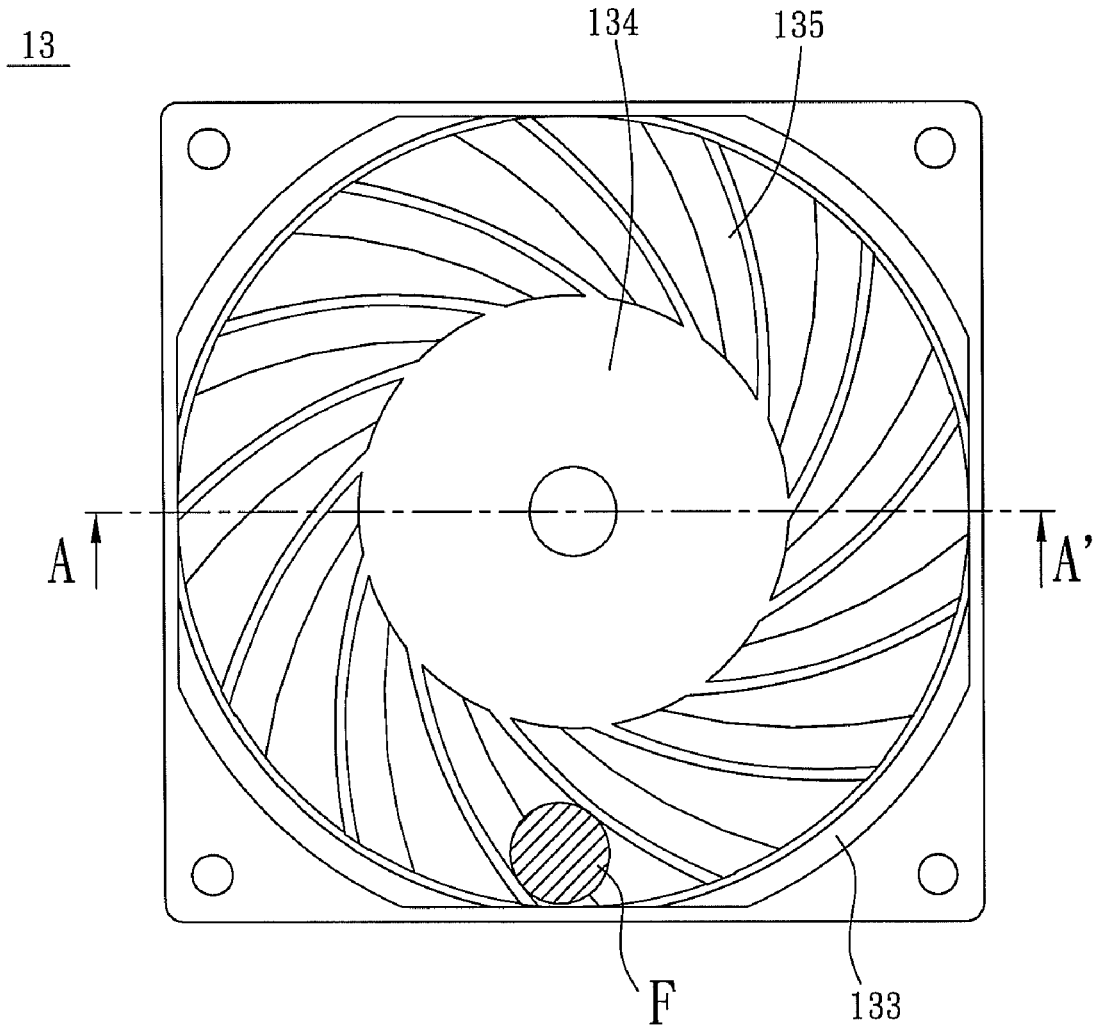
FIG. 1 is a schematic illustration showing a fan frame thereof according to an embodiment of the present invention.
Figure 2:
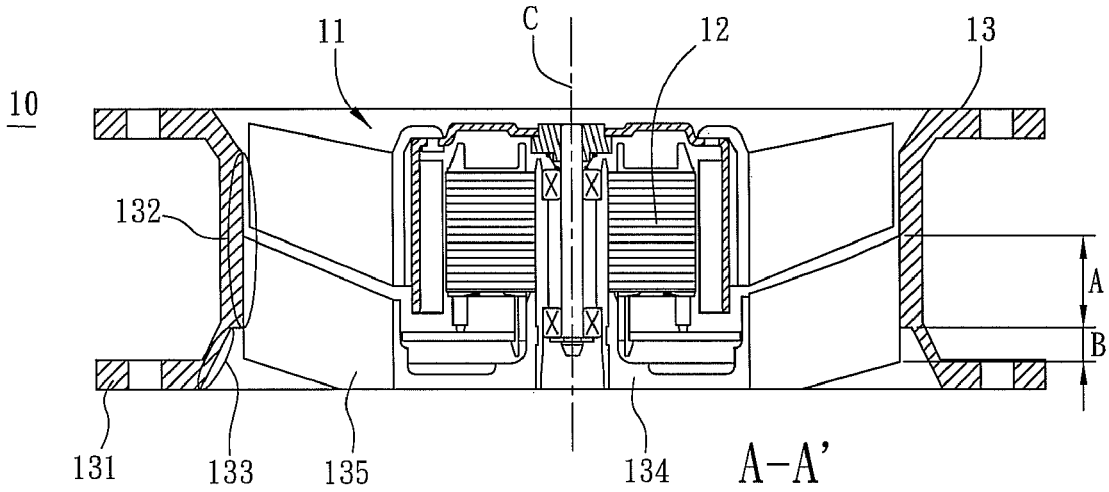
FIG. 2 is a cross-sectional view of a fan using the fan frame along the line A-A' in FIG. 1.

With reference to FIGS. 1 and 2, FIG. 1 is a schematic illustration showing a fan frame thereof according to an embodiment of the present invention, and FIG. 2 is a cross-sectional view of a fan using the fan frame along the line A-A' in FIG. 1. In FIG. 2, a fan 10 according to an embodiment of the present invention includes an impeller 11, a motor 12 and a fan frame 13. The motor 12 is coupled to the impeller 11 and drives the impeller 11 to rotate. The impeller 11 and the motor 12 are accommodated in the fan frame 13. The fan frame 13 includes a main body 131, an inner circular portion 132 formed with a passage and a guiding portion 133 forming an outlet.

The guiding portion 133 is connected to the inner circular portion 132. A motor base 134 is disposed in the main body 131 and located at a center of the passage. A plurality of supporting elements 135 are connected between the inner circular portion 132 of the main body 131 and the motor base 132. Each supporting element 135 has a suspended portion B, which is disposed near the inner circular portion 132 and is not connected to the guiding portion 133. The fan 10 is applied to an electronic system such as a power supplier, server, communication device, vehicle electronic device or computer. In the embodiment, the main body 131 of the fan 10 is roughly circular, elliptic or polygonal.

Figure 3:
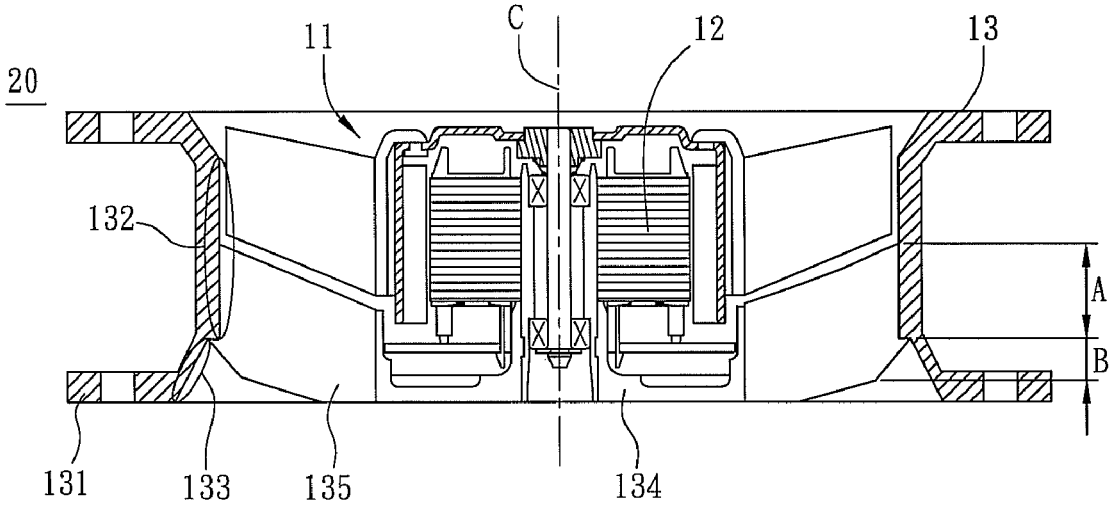
FIG. 3 is a cross-sectional view of another fan.

With reference to FIGS. 2 and 3, and FIG. 3 is a cross-sectional view of another fan 20. The supporting elements 135 and the main body 131 are integrally formed as a single unit. Each supporting element 135 is a stationary blade or a rib, and the shape of each supporting element 135 is wing-shaped or plate-shaped. The supporting element 135 is extended from the motor base 135 towards the main body 131 and connected to the inner circular portion 132 to form a connecting section A. The length of the connecting section A is greater than or equal to the depth of the suspended portion B. The lateral projection of the suspended portion B is parallel to a central line C of the passage as shown in FIG. 2. Alternatively, the lateral projection of the suspended portion B may be not parallel to the central line C of the passage as shown in FIG. 3.

The number of the supporting elements 135 is larger than 1.3 times of a dimension of the fan frame 13. Thus, the fan frame 13 has enough supporting elements 135 to provide sufficient air pressure and protection. Under this configuration, when the interval between every two adjacent supporting elements 135 is tested by a cylindrical measuring tool F, which has a diameter of 12 mm, the cylindrical measuring tool F can not pass through the interval as shown in FIG. 1. Accordingly, the fan 10 of the present invention can prevent the user from touching the rotating impeller 11.

Figure 4:
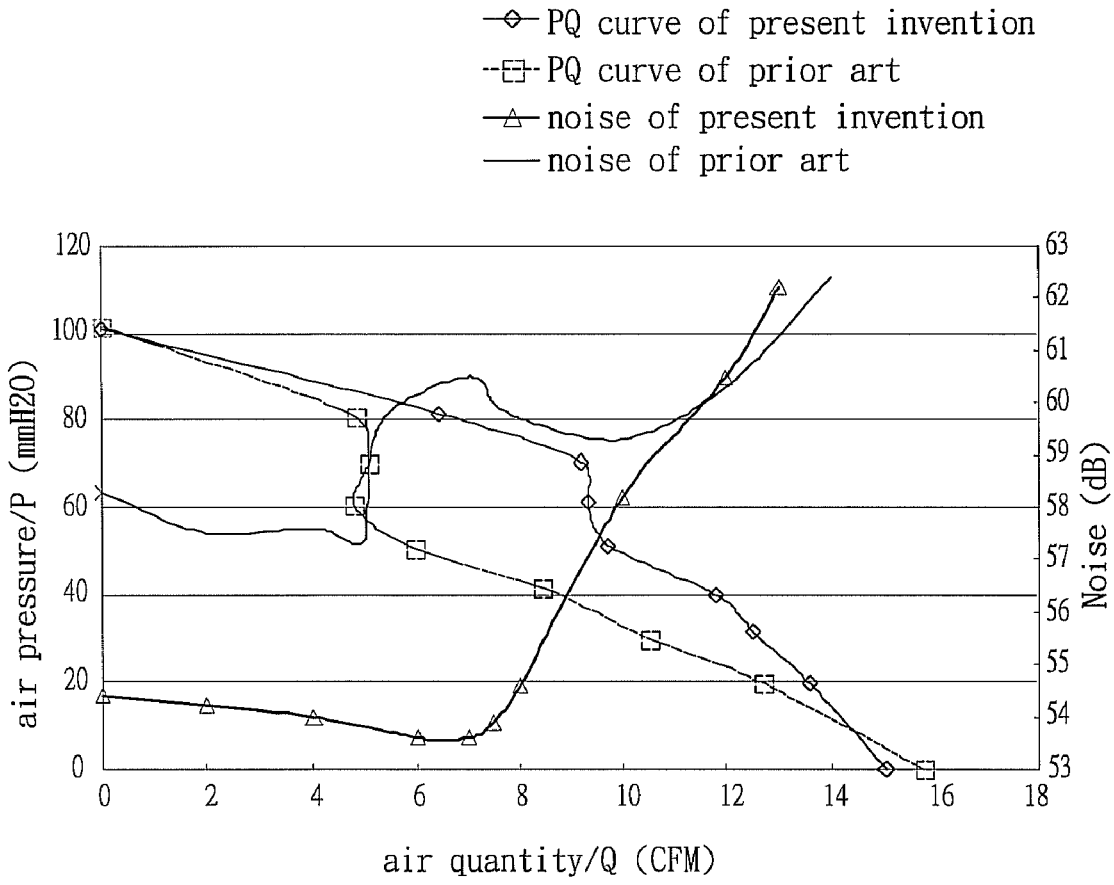
FIG. 4 is a schematic diagram showing the comparisons in the characteristic curves of air quantity and air pressure and the noises between the fans of the present invention and the prior art.

In summary, the fan and fan frame of the present invention can provide the supporting elements, which are not connected to the guiding portion in the outlet and have the suspended portion. Thus, the redundant structure connected to the guiding portion, which may cause the resistance of the airflow, can be avoided, so that the air pressure characteristics can be maintained or enhanced and the noise generated by the impact of the airflow and the structure can be decreased, as shown in FIG. 4.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan frame, comprising:

a main body, comprising:

an inner circular portion formed with a passage, and a guiding portion connected to the inner circular portion and forming an outlet;

a motor base disposed in the main body and located at a center of the passage; and a plurality of supporting elements connected between the inner circular portion of the main body and the motor base, wherein each of the supporting elements has a suspended portion, which is not connected to the guiding portion.

2. The fan frame according to claim 1, wherein each of the supporting elements is a stationary blade which is wing-shaped or a rib which is plate-shaped.

3. The fan frame according to claim 1, wherein a number of the supporting elements is larger than 1.3 times of a dimension of the fan frame.

4. The fan frame according to claim 1, wherein an interval is disposed between every two adjacent supporting elements, and the interval can not allow a cylindrical measuring tool with a diameter of 12 mm to pass therethrough.

5. The fan frame according to claim 1, wherein each of the supporting elements is extended from the motor base towards the main body and connected to the inner circular portion to form a connecting section.

6. The fan frame according to claim 5, wherein a length of the connecting section in each of the supporting elements is greater than or equal to that of the suspended portion.

7. The fan frame according to claim 1, wherein a lateral projection of the suspended portion of the supporting element is parallel to or not parallel to a central line of the passage.

8. The fan frame according to claim 1, wherein the supporting elements and the main body are integrally formed as a single unit.

9. The fan frame according to claim 1, wherein the main body is roughly circular, elliptic or polygonal.

10. A fan, comprising an impeller;

a motor coupled to the impeller and driving the impeller to rotate; and a fan frame accommodating the impeller and the motor and the fan frame comprising:

a main body comprising an inner circular portion formed with a passage and a guiding portion connected to the inner circular portion and forming an outlet, a motor base disposed in the main body and located at a center of the passage, and a plurality of supporting elements connected between the inner circular portion of the main body and the motor base, wherein each of the supporting elements has a suspended portion, which is not connected to the guiding portion.

11. The fan according to claim 10, wherein each of the supporting elements is a stationary blade which is wing-shaped or a rib which is plate-shaped.

12. The fan according to claim 10, wherein the fan frame has a side edge of several centimeters, and a number of the supporting elements is an integral larger than 1.3 times of the length of the side edge.

13. The fan according to claim 10, wherein an interval is disposed between every two adjacent supporting elements, and the interval can not allow a cylindrical measuring tool with a diameter of 12 mm to pass therethrough.

14. The fan according to claim 10, wherein each of the supporting elements is extended from the motor base towards the main body and connected to the inner circular portion to form a connecting section.

15. The fan according to claim 14, wherein a length of the connecting section in each of the supporting elements is greater than or equal to that of the suspended portion.

16. The fan according to claim 10, wherein a lateral projection of the suspended portion of the supporting element is parallel to or not parallel to a central line of the passage.

17. The fan according to claim 10, wherein the supporting elements and the main body are integrally formed as a single unit.

18. The fan according to claim 10, wherein a cross section of the main body is roughly circular, elliptic or polygonal.

19. The fan according to claim 10, which is applied to an electronic system, such as a power supplier, server, communication device, vehicle electronic device or computer.

* * * * *